US009523286B2

(12) United States Patent
Waki et al.

(10) Patent No.: US 9,523,286 B2
(45) Date of Patent: Dec. 20, 2016

(54) VANE SEGMENT AND AXIAL-FLOW FLUID MACHINE INCLUDING THE SAME

(71) Applicant: MITSUBISHI HEAVY INDUSTRIES, LTD., Tokyo (JP)

(72) Inventors: Kunihiko Waki, Tokyo (JP); Kenichi Arase, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 941 days.

(21) Appl. No.: 13/850,076

(22) Filed: Mar. 25, 2013

(65) Prior Publication Data

US 2013/0259673 A1 Oct. 3, 2013

(30) Foreign Application Priority Data

Mar. 30, 2012 (JP) ..... 2012-079253

(51) Int. Cl.

| | |
|---|---|
| ***F03B 1/00*** | (2006.01) |
| ***F03B 11/02*** | (2006.01) |
| ***F03D 5/00*** | (2006.01) |
| ***F01D 25/00*** | (2006.01) |
| ***F01D 9/04*** | (2006.01) |
| ***F04D 29/54*** | (2006.01) |

(52) U.S. Cl.

CPC ..... *F01D 25/00* (2013.01); *F01D 9/041* (2013.01); *F01D 9/044* (2013.01); *F04D 29/542* (2013.01)

(58) Field of Classification Search

CPC ..... F01D 25/00; F01D 9/044; F01D 9/041; F04D 29/542

USPC ..... 415/209.4

See application file for complete search history.

(56) References Cited

U.S. PATENT DOCUMENTS

| | | | |
|---|---|---|---|
| 3,326,523 | A | 6/1967 | BoBo |
| 3,442,442 | A | 5/1969 | Seiwert |

(Continued)

FOREIGN PATENT DOCUMENTS

| | | | |
|---|---|---|---|
| CN | 1116271 | A | 2/1996 |
| CN | 101363457 | A | 2/2009 |

(Continued)

OTHER PUBLICATIONS

International Search Report of PCT/JP2013/058304, mailing date of Jun. 25, 2013, w/English translation.

(Continued)

*Primary Examiner* — Jason Shanske

(74) *Attorney, Agent, or Firm* — Westerman, Hattori, Daniels & Adrian, LLP

(57) ABSTRACT

A vane segment according to the present invention includes: an outer connection member connecting a plurality of vanes; positioning jigs for positioning end vanes located at both ends, of the plurality of vanes; and radial restriction sections which restrict the outer connection member so as to be relatively immovable to an outer side in a radial direction of a vane ring, wherein: each of the plurality of vanes has a vane main body and an outer shroud; grooves are formed in the outer shrouds; openings into each of which the positioning jig is inserted are formed in portions of the outer connection member; holes into each of which the positioning jig inserted in the opening is inserted are formed in bottoms of the grooves of the two end vanes; and at least one of the positioning jigs is an eccentric positioning jig.

10 Claims, 7 Drawing Sheets

(56) References Cited

U.S. PATENT DOCUMENTS

| | | | | |
|---|---|---|---|---|
| 5,022,818 | A | 6/1991 | Scalzo | |
| 7,854,583 | B2 * | 12/2010 | Wichmann | F04D 29/322 415/1 |
| 7,914,255 | B2 * | 3/2011 | Workman | F01D 9/042 29/889.22 |
| 2009/0041580 | A1 | 2/2009 | Wichmann et al. | |
| 2010/0098537 | A1 * | 4/2010 | Hamana | F01D 9/041 415/209.3 |
| 2010/0135782 | A1 * | 6/2010 | Nakamura | F01D 9/041 415/209.3 |
| 2011/0052397 | A1 | 3/2011 | Kusters et al. | |
| 2011/0150643 | A1 | 6/2011 | Wery et al. | |
| 2011/0318174 | A1 * | 12/2011 | Grelin | F04D 29/164 415/193 |

FOREIGN PATENT DOCUMENTS

| | | | |
|---|---|---|---|
| CN | 101617129 | A | 12/2009 |
| JP | 62-267598 | A | 11/1987 |
| JP | 09-013754 | A | 1/1997 |
| JP | 2628604 | B2 | 7/1997 |
| JP | 2001-344886 | A | 12/2001 |
| JP | 2001344886 | A * | 12/2001 |
| JP | 2009-041563 | A | 2/2009 |
| JP | 2009-097370 | A | 5/2009 |
| JP | 2011-047406 | A | 3/2011 |
| JP | 2011-202600 | A | 10/2011 |
| KR | 10-2009-0104112 | A | 10/2009 |

OTHER PUBLICATIONS

Written Opinion of PCT/JP2013/058304, mailing date of Jun. 25, 2013, w/English translation.

Office Action dated Jan. 4, 2016, issued in Chinese Patent Application No. 201380012007.9, with English translation. (17 pages).

Office Action dated Jan. 5, 2016, issued in Japanese Patent Application No. 2012-079253, with English translation. (8 pages).

Office Action dated Mar. 5, 2016, issued in counterpart Korean Patent Application No. 10-2014-7026564, with English translation. (8 pages).

* cited by examiner

VANE SEGMENT AND AXIAL-FLOW FLUID MACHINE INCLUDING THE SAME

BACKGROUND OF THE INVENTION

Field of the Invention

The present invention relates to a vane segment configuring a part of a vane ring, and an axial-flow fluid machine which includes the vane segment.

Priority is claimed on Japanese Patent Application No. 2012-079253, filed on Mar. 30, 2012, the contents of which are incorporated herein by reference.

Description of Related Art

A gas turbine includes a compressor which compresses external air, thereby generating compressed air, a combustor which mixes fuel with the compressed air and burns the mixture, thereby generating combustion gas, and a turbine which is driven by the combustion gas.

The compressor is an axial-flow fluid machine and includes a rotor which rotates around an axis of rotation, and a casing which covers the rotor. The rotor has a rotor main body which extends in an axial direction parallel to the axis of rotation, and a plurality of blade stages which are fixed to the outer periphery of the rotor main body and arranged in the axial direction. A vane stage is fixed to the inner periphery side of the casing at a position on the upstream side of each blade stage. A single vane stage forms a vane ring in which a plurality of vanes are arranged in a circumferential direction and connected to each other. The vane ring is divided in the circumferential direction for the convenience of assembly. Each section divided in the circumferential direction is generally referred to as a vane segment. The vane segment is configured by connecting the plurality of vanes in the circumferential direction.

For example, a vane segment described in Patent Document 1 has a plurality of vanes, and a coupling member for connecting the plurality of vanes to each other. A groove which is dented toward a radial inner side from a radial outer side and extends in a circumferential direction is formed in each of outer shrouds of the plurality of vanes. The coupling member is put in the groove of each vane and welded to each vane.

PRIOR ART DOCUMENT

[Patent Document]

[Patent Document 1] Japanese Unexamined Patent Application, First Publication No. 2009-97370

SUMMARY OF THE INVENTION

In the vane segment described in Patent Document 1, since each of the plurality of vanes is welded to the coupling member, rattling between the plurality of vanes is very small. However, since welding heat is applied to the vane, there is a problem in that deformation of the vane or cracking of a welded portion due to thermal stress may occur. Further, in the vane segment described in Patent Document 1, since it is necessary to weld each of the plurality of vanes to the coupling member, there is also a problem in that the number of assembly steps of the vane segment increases.

The present invention is focused on the above-described problems and has an object to provide a vane segment in which it is possible to suppress deformation or cracking of a vane while reducing rattling between the plurality of vanes and reduce the number of assembly steps, and an axial-flow fluid machine which includes the vane segment.

(1) According to an aspect of the present invention, a vane segment is provided which configures a part of a vane ring and in which a plurality of vanes are connected in a circumferential direction, including: an outer connection member which extends in the circumferential direction and connects the plurality of vanes; positioning jigs for positioning end vanes located at both ends in the circumferential direction of the plurality of vanes with respect to the outer connection member; and radial restriction sections which restrict the outer connection member so as to be relatively immovable to an outer side in a radial direction of the vane ring with respect to at least one vane of the plurality of vanes, wherein: each of the plurality of vanes has a vane main body extending in the radial direction and an outer shroud provided at a radial outer side of the vane main body; grooves are formed in the outer shrouds, the grooves being dented toward a radial inner side from a radial outer side, extending in the circumferential direction, and connected to each other in a state where the plurality of vanes are arranged in the circumferential direction so as to allow the outer connection member to be fitted thereinto; openings are formed in each of portions of the outer connection member which fit into the grooves of the two end vanes, each of the openings penetrating in the radial direction such that the positioning jig is inserted thereinto; holes are formed in bottoms of the grooves of the two end vanes, the holes being dented toward a radial inner side such that the positioning jigs inserted into each of the openings of the outer connection member are inserted thereinto; and at least one positioning jig of the positioning jigs which perform positioning of the two end vanes is an eccentric positioning jig having a first columnar portion and a second columnar portion which is eccentric with respect to a central axis of the first columnar portion.

In the vane segment, the plurality of vanes can be restricted so as to be relatively immovable to the radial outer side by the outer connection member. Further, in the vane segment, in a state where the outer shrouds of the plurality of vanes are in close contact with each other in the circumferential direction, the positions in the circumferential direction of the plurality of outer shrouds with respect to the outer connection member can be restricted by the two positioning jigs. Therefore, in the vane segment, it is possible to highly reduce rattling between the plurality of vanes.

Further, in the vane segment, since it is not necessary to perform welding to each of the plurality of vanes, deformation or cracking of the vane due to welding can be eliminated and also the number of assembly steps can be reduced.

(2) An inner diameter of at least one of the holes of the two end vanes may be an inner diameter which corresponds to an outer diameter of the first columnar portion of the eccentric positioning jig and which allows insertion of the first columnar portion, and an inner diameter of at least one of the two openings of the outer connection member may be an inner diameter which corresponds to an outer diameter of the second columnar portion of the eccentric positioning jig and which allows insertion of the second columnar portion.

(3) As the radial restriction sections, collar portions which face a radial outer surface of the outer connection member fitted into the groove may be each formed at the two end vanes.

In the vane segment, since places where the outer connection member is supported so as to be relatively immovable to the radial outer side with respect to the plurality of outer shrouds are two places of both end portions in the circumferential direction of the outer connection member, the outer connection member can be stably supported.

(4) The two positioning jigs and the outer connection member may be welded to each other.

As a method to prevent falling off of the two positioning jigs from the outer connection member, various methods can be considered. However, by welding the positioning jigs to the outer connection member, it is possible to prevent falling off of the positioning jigs without increasing the number of components. In addition, since the welding is not welding treatment to the vane, the adverse effect of welding heat on the vane can be avoided.

(5) Each of the plurality of vanes may have an inner shroud provided at a radial inner side of the vane main body, and the vane segment may further include an inner connection member which is engaged with the inner shrouds of the plurality of vanes, thereby restricting the inner shrouds so as to be relatively immovable in the radial direction.

(6) According to another aspect of the present invention, an axial-flow fluid machine is provided, including: a vane ring configured of the plurality of vane segments.

According to the present invention, it is possible to suppress deformation or cracking of the vane while reducing rattling between the plurality of vanes and reduce the number of assembly steps.

DETAILED DESCRIPTION OF THE INVENTION

Hereinafter, an embodiment of an axial-flow fluid machine according to the present invention will be described in detail referring to FIGS. 1 to 8B.

Figure 1:
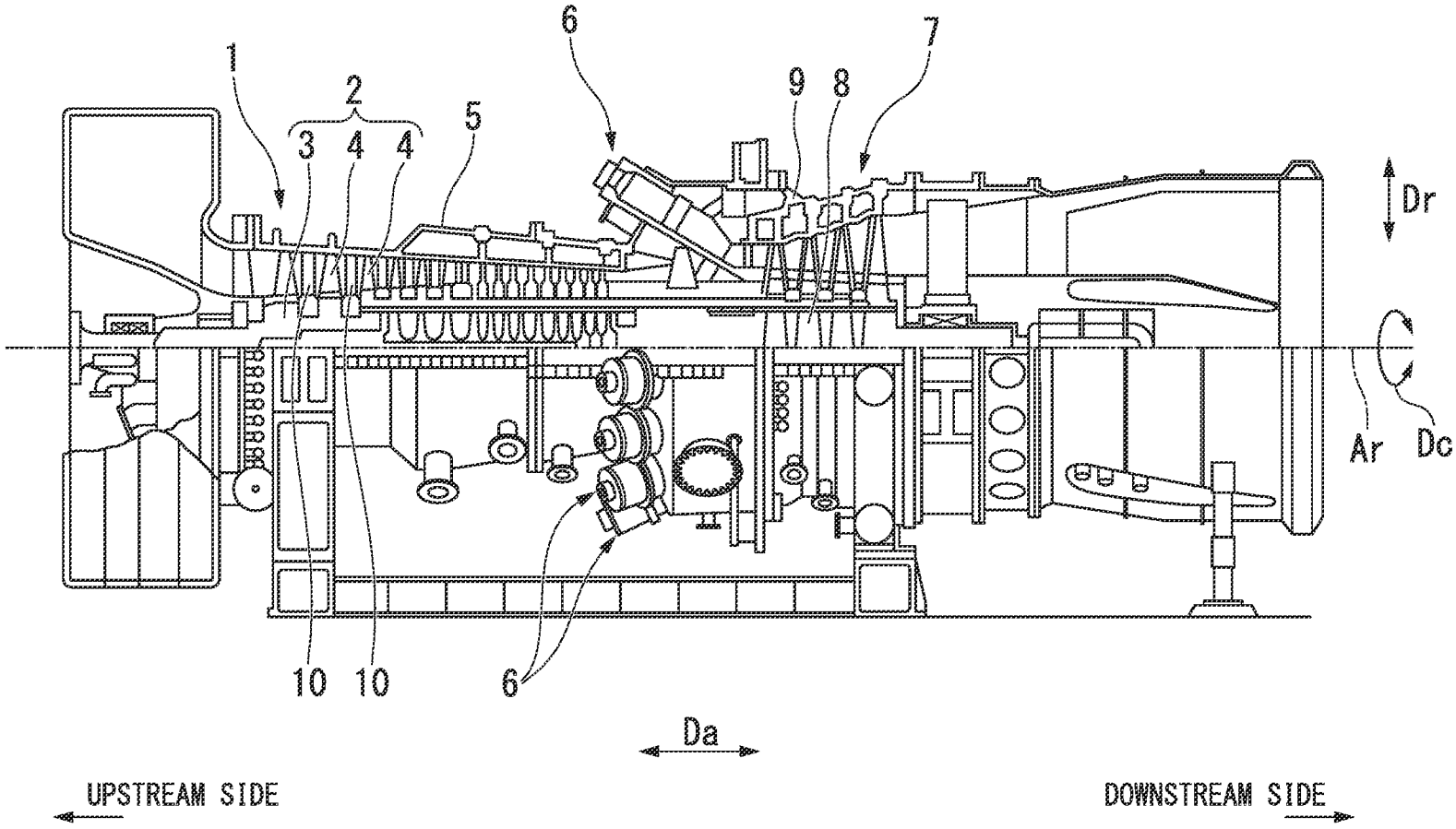
FIG. 1 is a cutaway side view of a main section of a gas turbine in an embodiment related to the present invention.

A gas turbine includes a compressor 1 which compresses external air, thereby generating compressed air, a plurality of combustors 6 which mixes fuel from a fuel supply source with the compressed air and burns the mixture, thereby generating combustion gas, and a turbine 7 which is driven by the combustion gas, as shown in FIG. 1.

Both the compressor 1 and the turbine 7 are axial-flow fluid machines and include rotors 2 and 8 which rotate around an axis of rotation Ar, and casings 5 and 9 which cover the rotors 2 and 8. The compressor rotor 2 and the turbine rotor 8 rotate around the same axis of rotation Ar and are connected to each other. The plurality of combustors 6 are fixed to the turbine casing 9 at equal intervals in a circumferential direction Dc around the axis of rotation Ar.

In the following, a direction in which the axis of rotation Ar extends is set to be an axial direction Da, and a radial direction with respect to the axis of rotation Ar is simply referred to as a radial direction Dr. Further, in the axial direction Da, the compressor 1 side based on the turbine 7 is referred to as an upstream side and the turbine 7 side based on the compressor 1 is referred to as a downstream side.

The compressor rotor 2 includes a rotor main body 3 which extends in the axial direction Da, and a plurality of blade stages 4 which are fixed to the outer periphery of the rotor main body 3 and arranged in the axial direction Da. A vane stage 10 is fixed to the inner periphery side of the compressor casing 5 at the position on the upstream side of each blade stage 4.

Figure 2:
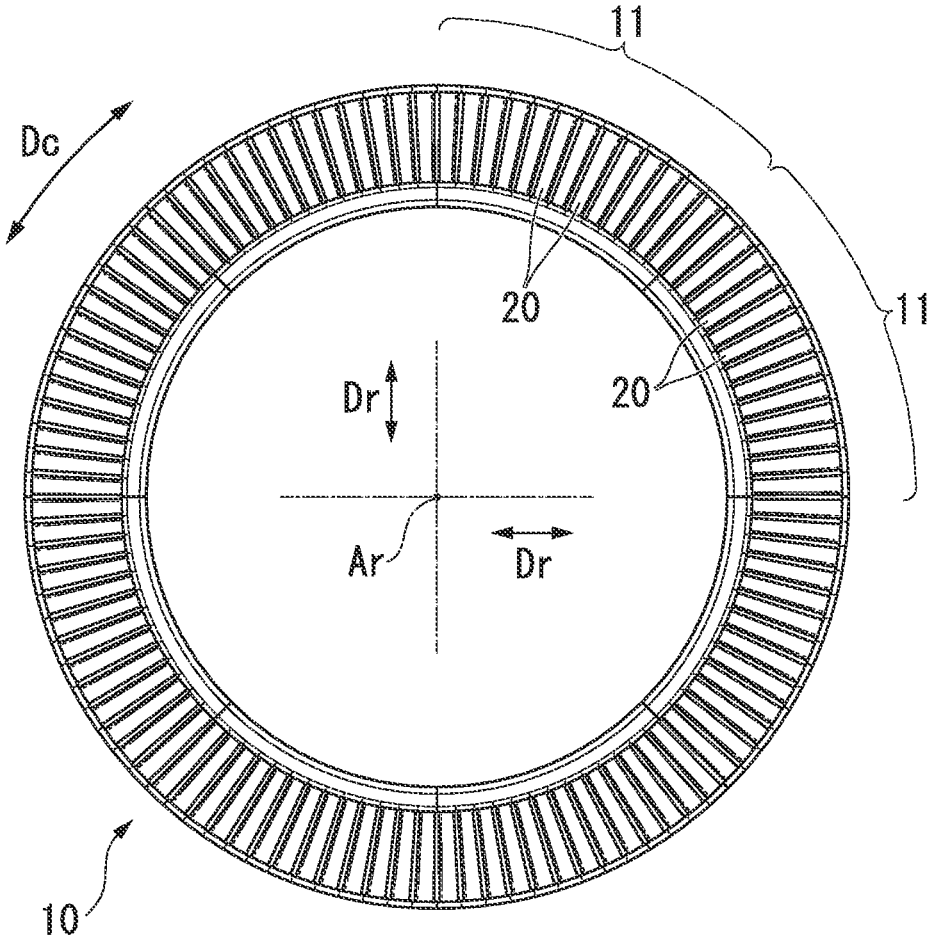
FIG. 2 is a front view of a vane stage (a vane ring) in an embodiment related to the present invention.

A single vane stage 10 is formed as a vane ring in which a plurality of vanes 20 are annularly arranged and connected to each other, as shown in FIG. 2. The vane ring is divided in the circumferential direction for convenience of assembly. Each section divided in the circumferential direction configures a vane segment 11. The vane segment 11 is a part in which some of the plurality of vanes 20 of the plurality of vanes 20 configuring the vane ring are arranged in the circumferential direction Dc and connected to each other.

Figure 3:
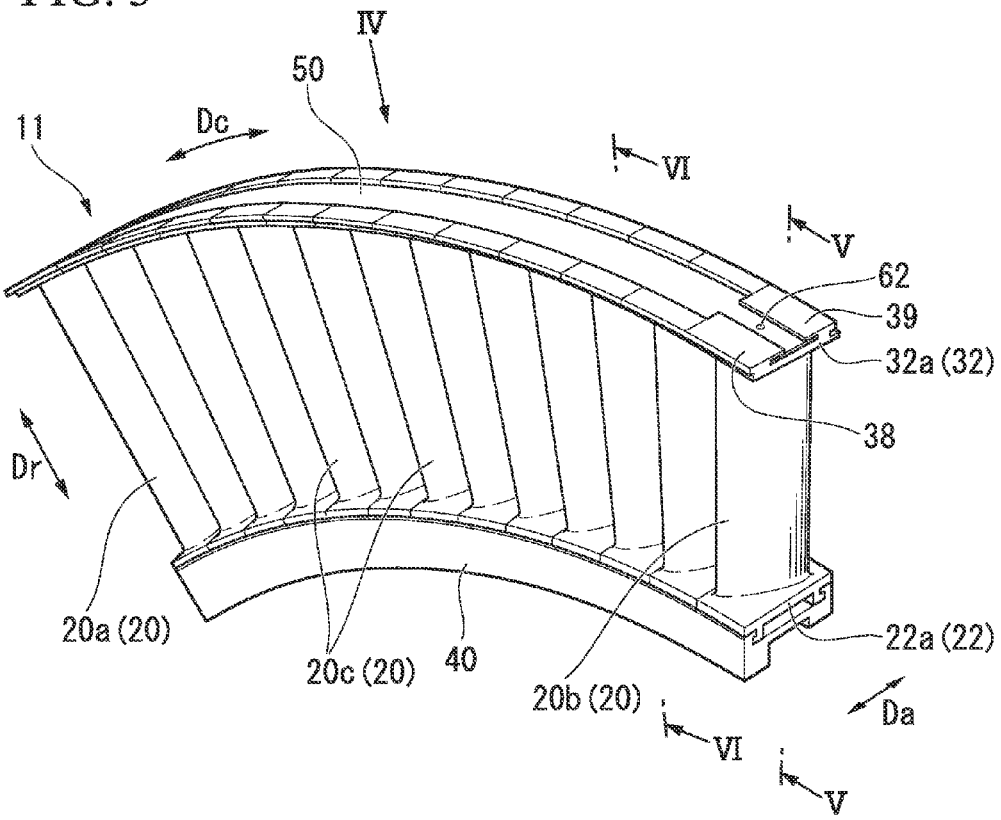
FIG. 3 is a perspective view of a vane segment in an embodiment related to the present invention.

The vane segment 11 includes the plurality of vanes 20 arranged in the circumferential direction Dc, a connection holder (an inner connection member) 40 on which radial inner portions of the plurality of vanes 20 are mounted, and a connection band (an outer connection member) 50 which connects radial outer portions of the plurality of vanes 20 to each other in the circumferential direction Dc, as shown in FIG. 3.

Figure 5:
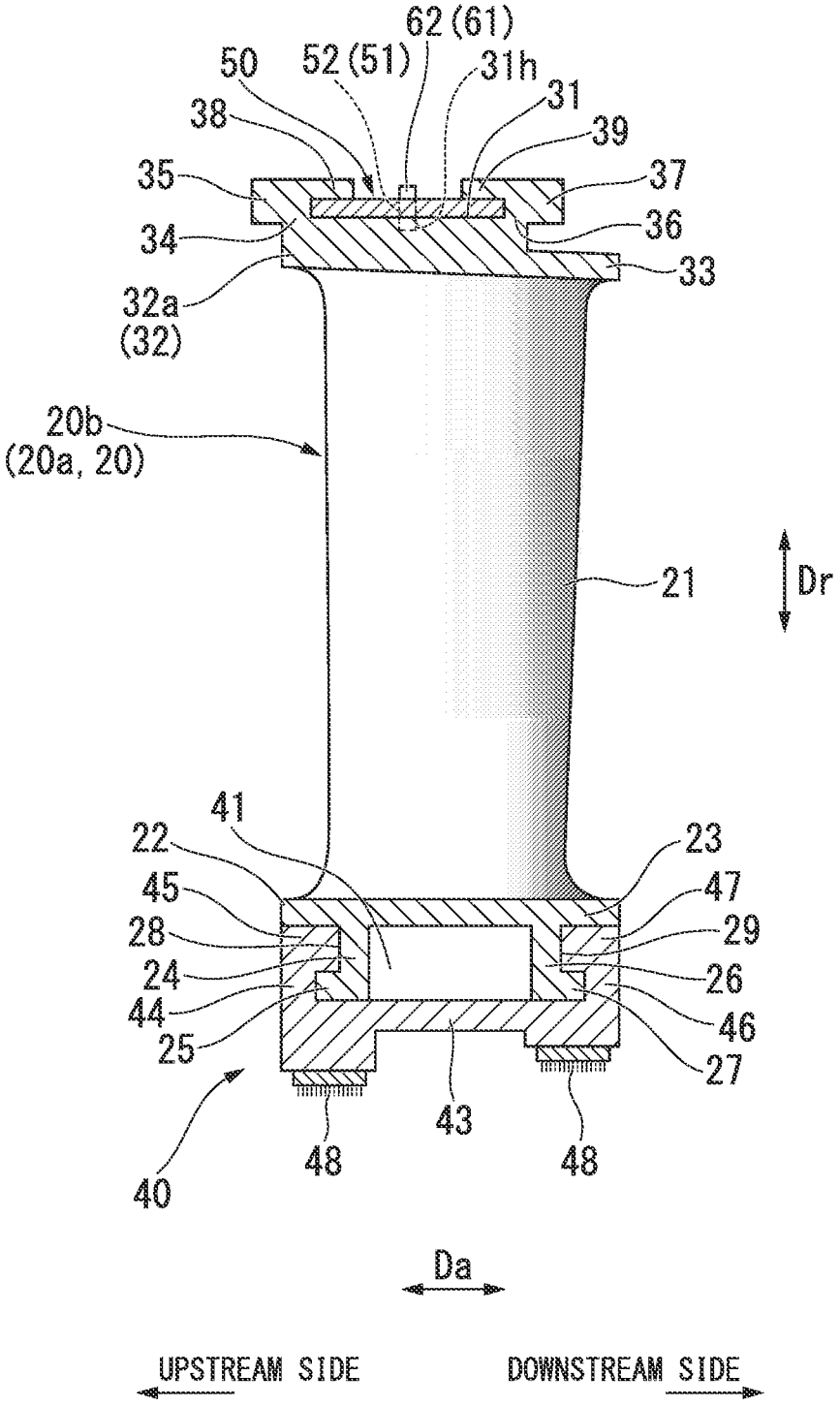
FIG. 5 is a cross-sectional view along line V-V in FIG. 3.
Figure 6:
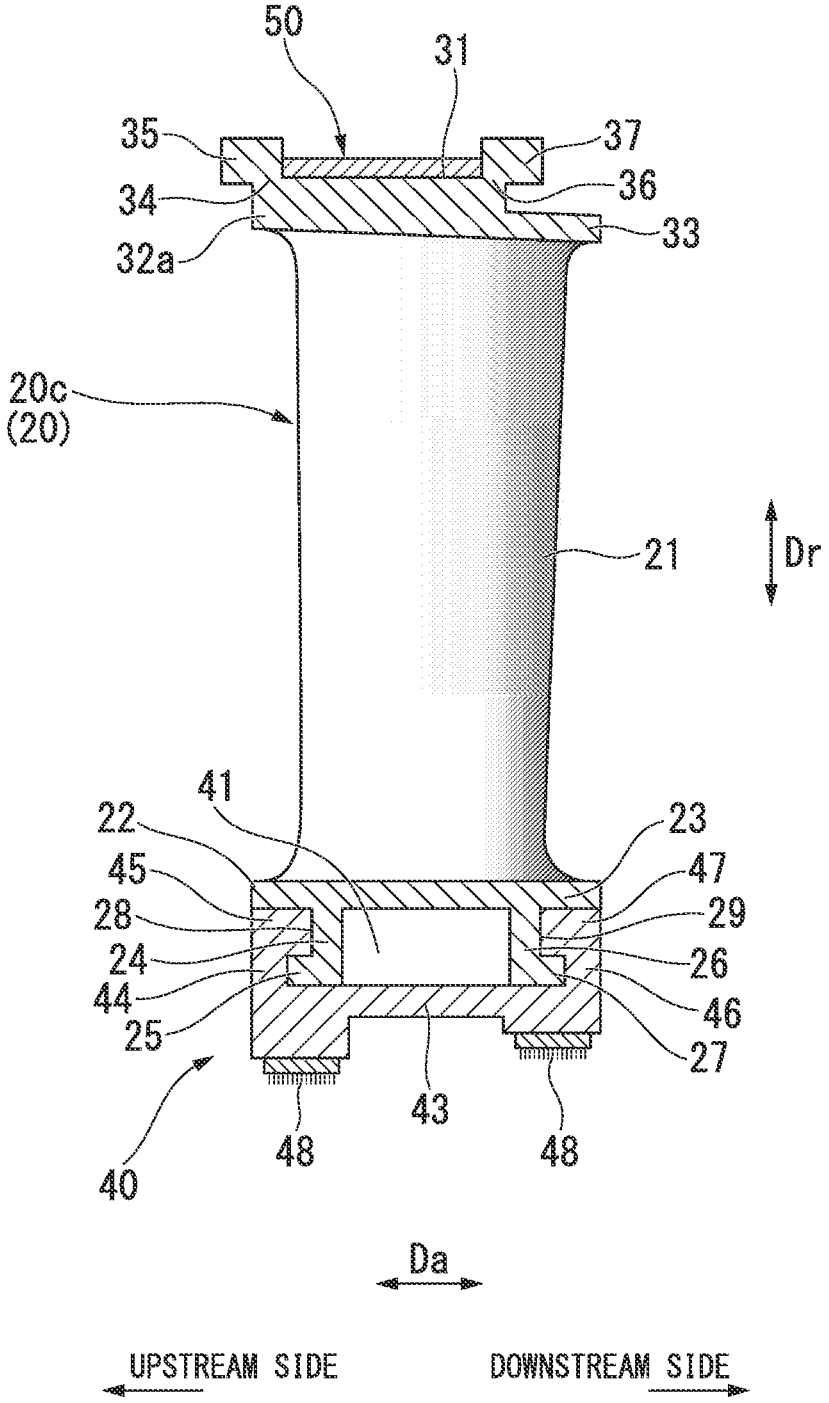
FIG. 6 is a cross-sectional view along line VI-VI in FIG. 3.

The vane 20 has a vane main body 21 which extends in the radial direction Dr, an inner shroud 22 provided on the radial inner side of the vane main body 21, and an outer shroud 32 provided on the radial outer side of the vane main body 21, as shown in FIGS. 5 and 6.

The inner shroud 22 has a plate-shaped shroud main body 23 which is provided on the radial inner side of the vane main body 21 and extends in the circumferential direction Dc, an upstream-side leg portion 24 which extends radially inward from an upstream-side portion of the shroud main body 23, an upstream-side lip portion 25 which extends from a radial inner end of the upstream-side leg portion 24 to the upstream side, a downstream-side leg portion 26 which extends radially inward from a downstream-side portion of the shroud main body 23, and a downstream-side lip portion 27 which extends from a radial inner end of the downstream-side leg portion 26 to the downstream side.

An upstream-side engagement groove 28 dented to the downstream side is formed between the shroud main body 23 and the upstream-side lip portion 25. Further, a downstream-side engagement groove 29 dented to the upstream side is formed between the shroud main body 23 and the downstream-side lip portion 27. All groove bottom portions of the engagement grooves 28 and 29 are formed by the leg portions 24 and 26.

The outer shroud 32 has a plate-shaped shroud main body 33 which is provided on the radial outer side of the vane main body 21 and extends in the circumferential direction Dc, an upstream-side leg portion 34 which extends radially outward from an upstream-side portion of the shroud main body 33, an upstream-side lip portion 35 which extends from a radial outer end of the upstream-side leg portion 34 to the upstream side, a downstream-side leg portion 36 which extends radially outward from a downstream-side portion of the shroud main body 33, and a downstream-side lip portion 37 which extends from a radial outer end of the downstream-side leg portion 36 to the downstream side.

A band groove 31 which is dented from the radial outer side to the radial inner side and extends in the circumferential direction Dc is formed between the upstream-side leg portion 34 and the downstream-side leg portion 36. A groove bottom portion of the band groove 31 is formed by the shroud main body 33. A portion in the circumferential direction Dc of the connection band 50 fits into the band groove 31.

An outer shroud 32*a* of each of end vanes 20*a* and 20*b* located at both ends in the circumferential direction Dc among the plurality of vanes 20 configuring the vane segment 11 further has an upstream-side flange portion (a collar portion, a radial restriction section) 38 which extends from a radial outer end of the upstream-side leg portion 34 to the downstream side, and a downstream-side flange portion (a collar portion, a radial restriction section) 39 which extends from a radial outer end of the downstream-side leg portion 36 to the upstream side, as shown in FIG. 5.

Both the upstream-side flange portion 38 and the downstream-side flange portion 39 face the radial outer surface of the connection band 50 fitted into the band groove 31 and perform a function to restrict the connection band 50 fitted into the band groove 31 so as to be relatively immovable to the outer side in the radial direction with respect to the end vanes 20*a* and 20*b*.

Further, a columnar hole 31*h* dented from the radial outer side to the radial inner side is formed in the band groove 31 in the outer shroud 32*a* of each of the end vanes 20*a* and 20*b*.

In this embodiment, in vanes 20*c* other than the end vanes 20*a* and 20*b*, the upstream-side flange portion 38, the downstream-side flange portion 39, and the hole 31*h* in each of the end vanes 20*a* and 20*b* are not formed, as shown in FIG. 6.

The connection holder 40 has a seal maintaining portion 43 which extends in the circumferential direction Dc, an upstream-side leg portion 44 which is formed along an upstream-side edge of the seal maintaining portion 43 and extends radially outward, an upstream-side flange portion 45 which extends from a radial outer end of the upstream-side leg portion 44 to the downstream side and fits into the upstream-side engagement groove 28 of the inner shroud 22, a downstream-side leg portion 46 which is formed along a downstream-side edge of the seal maintaining portion 43 and extends radially outward, and a downstream-side flange portion 47 which extends from a radial outer end of the downstream-side leg portion 46 to the upstream side and fits into the downstream-side engagement groove 29 of the inner shroud 22.

A seal device 48 which seals between the seal maintaining portion 43 and the rotor main body 3 (FIG. 1) of the compressor rotor 2 is provided on the radial inner side of the seal maintaining portion 43. A shroud-receiving groove 41 which is dented radially inward and extends in the circumferential direction Dc is formed between the upstream-side leg portion 44 and the downstream-side leg portion 46. A groove bottom portion of the shroud-receiving groove 41 is formed by the seal maintaining portion 43. The upstream-side leg portion 24, the upstream-side lip portion 25, the downstream-side leg portion 26, and the downstream-side lip portion 27 of the inner shroud 22 of each vane 20 fit into the shroud-receiving groove 41 in a state where the plurality of vanes 20 configuring the vane segment 11 are arranged in the circumferential direction Dc.

Figure 7:
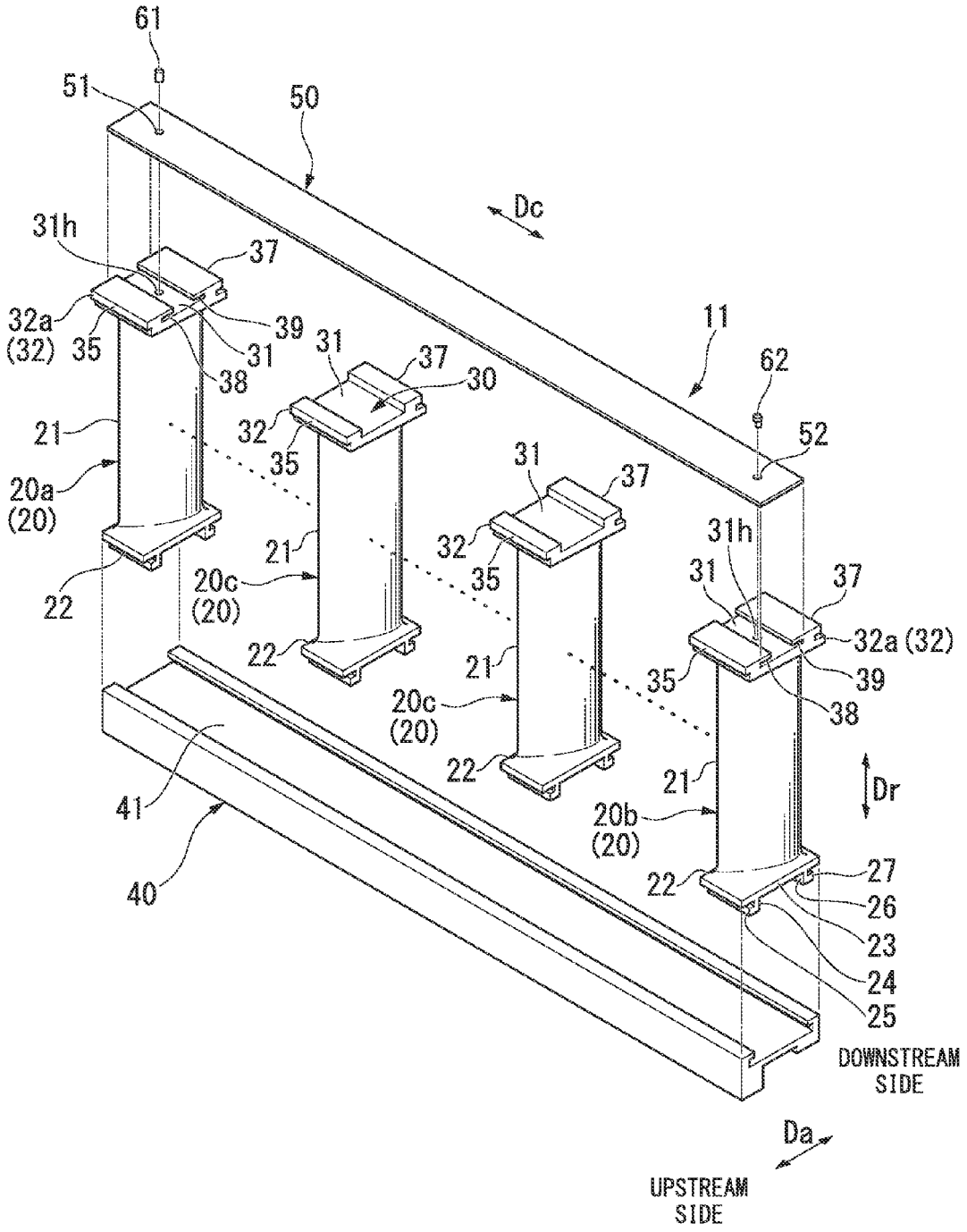
FIG. 7 is an exploded perspective view of the vane segment in an embodiment related to the present invention.

The width in the axial direction Da of the connection band 50 which extends in the circumferential direction Dc corresponds to the width in the axial direction Da of the band groove 31 such that the connection band 50 fits into the band groove 31 of the outer shroud 32, as shown in FIG. 7. Further, the length in the circumferential direction Dc of the connection band 50 corresponds to the total length in the circumferential direction Dc of the band grooves 31 of the inner shrouds 32 of the respective vanes 20 in a state where the plurality of vanes 20 configuring the vane segment 11 are arranged in the circumferential direction Dc.

In FIG. 7, in order to easily comprehensibly illustrate the shapes of the plurality of vanes 20 configuring the vane segment 11, the circumferential direction Dc is depicted in a direction shown by a straight line arrow.

A first opening 51 and a second opening 52 each penetrating the connection band 50 in the radial direction Dr and having a columnar shape are formed in the connection band 50. The position in the circumferential direction Dc and the axial direction Da of each of the holes 51 and 52 is a position corresponding to each of the holes 31*h* and 31*h* of the end vanes 20*a* and 20*b* in the connection band 50 in a state where the plurality of vanes 20 configuring the vane segment 11 are arranged in the circumferential direction Dc and the connection band 50 fits into the band grooves 31 of the respective vanes 20.

The vane segment 11 of this embodiment further has a first positioning jig 61 which is inserted into the first opening 51 of the connection band 50 and further inserted into the hole 31*h* of the end vane 20*a* on one side, and a second positioning jig 62 which is inserted into the second opening 52 of the connection band 50 and further inserted into the hole 31*h* of the end vane 20*b* on the other side, as shown in FIG. 7.

Figure 8A:
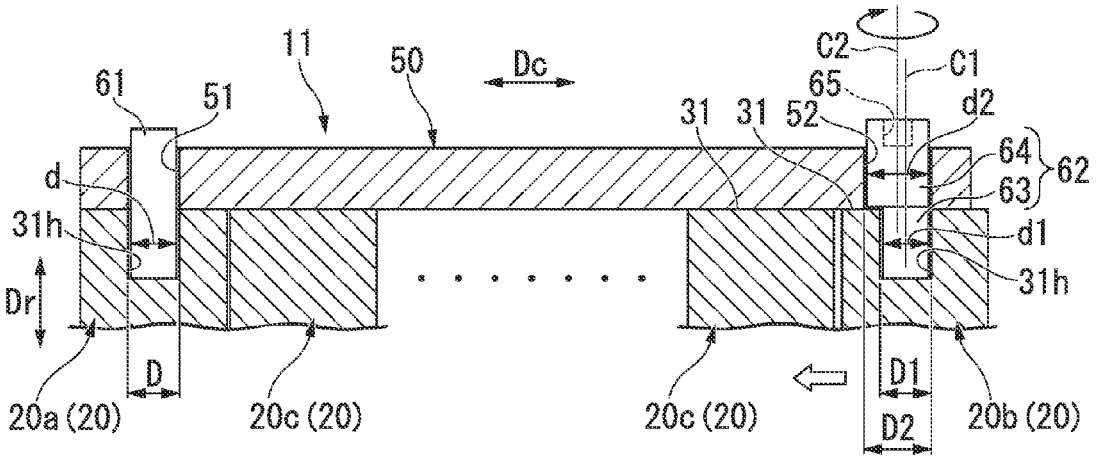
FIG. 8A is an explanatory diagram for explaining the effect of a positioning jig in an embodiment related to the present invention and shows a state before an operation of the positioning jig.
Figure 8B:
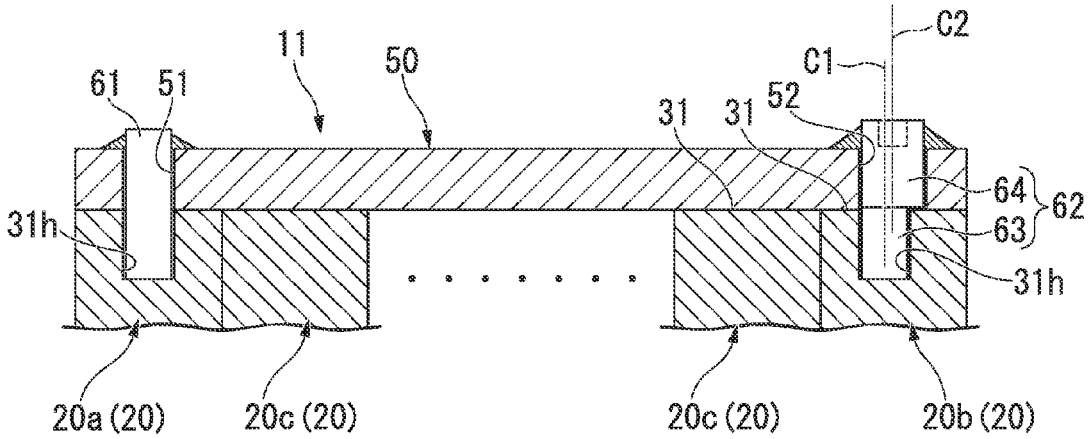
FIG. 8B is an explanatory diagram for explaining the effect of the positioning jig in an embodiment related to the present invention and shows a state after an operation of the positioning jig.

The first positioning jig 61 is a normal columnar pin, as shown in FIGS. 8A and 8B. On the other hand, the second positioning jig 62 has a first columnar portion 63 which is an eccentric pin and has a columnar shape centered on a first central axis C1, and a second columnar portion 64 which is provided at an end portion of the first columnar portion 63 and has a columnar shape centered on a second central axis C2 that is spaced from and is parallel to the first central axis C1.

The first columnar portion 63 of the second positioning jig 62 is a portion which is inserted into the hole 31*h* of the end vane 20*b*, and the second columnar portion 64 of the second positioning jig 62 is a portion which is inserted into the second opening 52 of the connection band 50.

A tool engagement portion 65, with which a tool that rotates the second positioning jig 62 around the second central axis C2 is engaged, is formed in an end portion which is an end portion of the second columnar portion 64 of the second positioning jig 62 and is on the opposite side to the first columnar portion 63. The tool engagement portion 65 may be, for example, a hexagonal columnar tool hole into which a hexagonal wrench fits, and may also be a hexagonal columnar bolt head on which a hexagonal socket can be mounted.

An inner diameter D of the hole 31*h* of the end vane 20*a* on one side, of the holes 31*h* and 31*h* of the two end vanes 20*a* and 20*b*, is an inner diameter which corresponds to an outer diameter d of the first positioning jig 61 and which allows insertion of the first positioning jig 61 substantially without rattling. Further, an inner diameter D1 of the hole 31*h* of the end vane 20*b* on the other side is an inner diameter which corresponds to an outer diameter d1 of the first columnar portion 63 of the second positioning jig 62 and which allows insertion of the first columnar portion 63 substantially without rattling.

In this embodiment, the outer diameter d of the first positioning jig 61 having a columnar shape and the outer diameter d1 of the first columnar portion 63 of the second positioning jig 62 are the same. For this reason, the inner diameter D of the hole 31*h* on one side and the inner diameter D1 of the hole 31*h* on the other side are the same. Therefore, in this embodiment, the two end vanes 20*a* and 20*b* have the same shape.

An inner diameter D of the first opening 51 of the connection band 50 is an inner diameter which corresponds to the outer diameter d of the first positioning jig 61, allows insertion of the first positioning jig 61 substantially without rattling, and is the same as the inner diameter D of the hole 31*h* of the end vane 20*a* on one side. In this embodiment, the inner diameters D and D1 of the respective holes 31*h* and 31*h* of the two end vanes 20*a* and 20*b* and the inner diameter D of the first opening 51 of the connection band 50 are the same.

An inner diameter D2 of the second opening 52 of the connection band 50 is an inner diameter which corresponds to an outer diameter d2 of the second columnar portion 64 of the second positioning jig 62 and which allows insertion of the second columnar portion 64 substantially without rattling.

Provided that the second central axis C2 of the second columnar portion 64 of the second positioning jig 62 is eccentric with respect to the first central axis C1 of the first columnar portion 63, the outer diameter of the second columnar portion 64 does not basically matter. However, in this embodiment, the outer diameter d2 of the second columnar portion 64 is larger than the outer diameter d1 of the first columnar portion 63. For this reason, the inner diameter D2 of the second opening 52 of the connection band 50 in this embodiment is larger than the inner diameters D and D1 of the respective holes 31*h* and 31*h* of the two end vanes 20*a* and 20*b* and the inner diameter D of the first opening 51 of the connection band 50.

The manufacturing procedure of the vane segment 11 described above will be described.

First, as shown in FIG. 7, the plurality of vanes 20, the connection holder 40, the connection band 50, the first positioning jig 61, and the second positioning jig 62 described above are prepared.

Next, the inner shrouds 22 of the plurality of vanes 20 are mounted on the connection holder 40. First, the inner shroud 22 of the end vane 20*a* on one side of the two end vanes 20*a* and 20*b* is mounted on the connection holder 40, and then, the inner shroud 22 of another vane 20*c* adjacent to the end vane 20*a* in the circumferential direction Dc is mounted on the connection holder 40. Thereafter, the inner shrouds 22 of other vanes 20 adjacent to each other in the circumferential direction Dc are sequentially mounted on the connection holder 40.

When the inner shroud 22 of the vane 20 is mounted on the connection holder 40, the inner shroud 22 is relatively moved in the circumferential direction Dc with respect to the connection holder 40, whereby the upstream-side leg portion 24, the upstream-side lip portion 25, the downstream-side leg portion 26, and the downstream-side lip portion 27 of the inner shroud 22 are put in the shroud-receiving groove 41 of the connection holder 40.

As shown in FIGS. 5 and 6, if the upstream-side leg portion 24, the upstream-side lip portion 25, the downstream-side leg portion 26, and the downstream-side lip portion 27 of the inner shroud 22 are put in the shroud-receiving groove 41 of the connection holder 40, the upstream-side flange portion 45 of the connection holder 40 fits into the upstream-side engagement groove 28 of the inner shroud 22 and the downstream-side flange portion 47 of the connection holder 40 fits into the downstream-side engagement groove 29 of the inner shroud 22.

As a result, the radial inner surface of the shroud main body 23 of the inner shroud 22 faces the radial outer surfaces of the upstream-side flange portion 45 and the downstream-side flange portion 47 of the connection holder 40. Further, the radial outer surface of the upstream-side lip portion 25 of the inner shroud 22 faces the radial inner surface of the upstream-side flange portion 45 of the connection holder 40 and the radial outer surface of the downstream-side lip portion 27 of the inner shroud 22 faces the radial inner surface of the downstream-side flange portion 47 of the connection holder 40. For this reason, the inner shroud 22 becomes relatively immovable in the radial direction Dr with respect to the connection holder 40.

The groove bottom face of the upstream-side engagement groove 28 of the inner shroud 22 faces the downstream-side end face of the upstream-side flange portion 45 of the connection holder 40 and the groove bottom face of the downstream-side engagement groove 29 of the inner shroud 22 faces the upstream-side end face of the downstream-side flange portion 47 of the connection holder 40. The inner shroud 22 becomes relatively immovable in the axial direction Da with respect to the connection holder 40.

If the inner shroud 22 of the vane 20 is mounted on the connection holder 40, the vane 20 becomes relatively immovable in the radial direction Dr and the axial direction Da with respect to the connection holder 40. If the inner shrouds 22 of the plurality of vanes 20 are mounted on the connection holder 40, the plurality of vanes 20 are arranged in the circumferential direction Dc with the mutual positions in the radial direction Dr and the axial direction Da coinciding with each other. If the plurality of vanes 20 are arranged in the circumferential direction Dc, a single groove 30 (FIG. 7) in which the band grooves 31 of the respective vanes 20 are connected in the circumferential direction Dc is formed.

Figure 4:
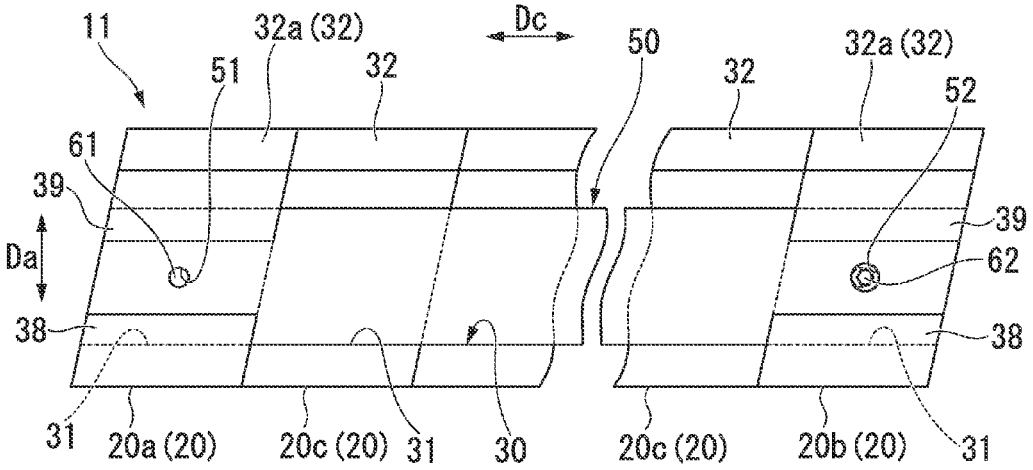
FIG. 4 is a view in the direction of arrow IV in FIG. 3.

Next, as shown in FIGS. 4 and 7, the connection band 50 is put in the single groove 30 in which the band grooves 31 of the respective vanes 20 are connected in the circumferential direction Dc. At this time, the connection band 50 is relatively moved in the circumferential direction Dc with respect to the band groove 31 of each vane 20, whereby the connection band 50 is put in each band groove 31. At the point of time when the positions of the hole 31*h* of the end vane 20*a* on one side of the two end vanes 20*a* and 20*b* and the first opening 51 of the connection band 50 coincide with each other and the hole 31*h* of the end vane 20*b* on the other side reaches a position can be seen from the second opening 52 of the connection band 50, the connection band 50 is completely fitted into the groove 30.

If the connection band 50 is completely fitted into the groove 30, the upstream-side end face of the connection band 50 faces the surface on the downstream side of the upstream-side leg portion 34 of the outer shroud 32 of each vane 20 and the downstream-side end face of the connection band 50 faces the surface on the upstream side of the downstream-side leg portion 36 of the outer shroud 32 of each vane 20, as shown in FIGS. 5 and 6. The outer shroud 32 of each vane 20 becomes substantially and relatively immovable in the axial direction Da with respect to the connection band 50.

The radial outer surface of the connection band 50 faces the radial inner surfaces of the upstream-side flange portion 38 and the downstream-side flange portion 39 of each of the end vanes 20*a* and 20*b*. For this reason, the connection band 50 becomes substantially and relatively immovable to a side (a radial outer side) getting away in the radial direction Dr, with respect to the outer shrouds 32 of the plurality of vanes 20. The connection band 50 becomes substantially and relatively immovable to a side (a radial inner side) approaching in the radial direction Dr, with respect to the outer shrouds 32 of the plurality of vanes 20.

Next, as shown in FIG. 8A, the first positioning jig 61 is inserted into the first opening 51 of the connection band 50 and further inserted into the hole 31*h* of the end vane 20*a* on one side. As a result, the relative position in the circumferential direction Dc of the outer shroud 32*a* of the end vane 20*a* on one side with respect to the connection band 50 is determined.

Subsequently, after the position of the first central axis C1 of the second positioning jig 62 and the position of the central axis of the hole 31*h* of the end vane 20*b* on the other side are made to coincide with each other, the second positioning jig 62 is inserted into the second opening 52 of the connection band 50 and the first columnar portion 63 of the second positioning jig 62 is further inserted into the hole 31*h* of the end vane 20*b* on the other side. In this process, the second columnar portion 64 of the second positioning jig 62 is inserted into the second opening 52 of the connection band 50.

Next, a tool is engaged with the tool engagement portion 65 of the second positioning jig 62 and the second positioning jig 62 is then rotated around the second central axis C2 of the second columnar portion 64. If the second positioning jig 62 is rotated around the second central axis C2, the first columnar portion 63 which is eccentric with respect to the second columnar portion 64 of the second positioning jig 62 is rotated around the second central axis C2, thereby being moved in a direction perpendicular to the second central axis C2. As a result, the outer shroud 32*a* of the end vane 20*b* on the other side in which the first columnar portion 63 of the second positioning jig 62 is inserted moves in the direction perpendicular to the second central axis C2.

The hole 31*h* of the end vane 20*b* on the other side in which the first columnar portion 63 of the second positioning jig 62 is inserted is a hole dented in the radial direction Dr, and the second opening 52 of the connection band 50 in which the second columnar portion 64 of the second positioning jig 62 is inserted is a hole penetrating the connection band 50 in the radial direction Dr. Therefore, the second central axis C2 of the second positioning jig 62, when the first columnar portion 63 of the second positioning jig 62 is inserted into the hole 31*h* of the end vane 20*b* on the other side, extends in the radial direction Dr. The outer shroud 32 of the end vane 20*b* on the other side moves in a direction perpendicular to the radial direction Dr due to rotation of the second positioning jig 62.

In a case where the respective outer shrouds 32 of the plurality of vanes 20 are not in close contact with each other in the circumferential direction Dc, as shown in FIG. 8A, by rotating the second positioning jig 62, the outer shroud 32 of the end vane 20*b* on the other side is moved toward the end vane 20*a* on one side in the circumferential direction Dc, as shown in FIG. 8B, whereby the respective outer shroud 32 of the plurality of vanes 20 can be brought into close contact with each other in the circumferential direction Dc. At the point of time when the respective outer shrouds 32 of the plurality of vanes 20 come into close contact with each other in the circumferential direction Dc, the positions in the circumferential direction Dc of the outer shrouds 32 of the plurality of vanes 20 are determined.

The positions in the circumferential direction Dc of the outer shrouds 32 of the plurality of vanes 20 are determined by the first positioning jig 61 and the second positioning jig 62.

Next, the first positioning jig 61 and the second positioning jig 62 are welded and joined to the connection band 50.

By the above, the respective members configuring the vane segment 11 are integrated, whereby the vane segment 11 is completed.

In this embodiment, since the outer shrouds 32 of the plurality of vanes 20 can be brought into close contact with each other in the circumferential direction Dc by an operation of the second positioning jig 62, it is possible to highly reduce rattling between the plurality of vanes 20.

Further, in this embodiment, since welding places are only welds of the first positioning jig 61 and the second positioning jig 62 to the connection band 50 and the number of welding places is very small and the amount of welding in one place is also small, the number of assembly steps can be reduced.

In addition, in this embodiment, since welding is not performed on the vane 20, deformation or cracking of the vane 20 due to welding can be eliminated.

Further, in this embodiment, if portions protruding from the connection band 50 in the first positioning jig 61 and the second positioning jig 62 are cut, the vane segment 11 can be easily disassembled for each component. For example, even if one vane 20 of the plurality of vanes 20 configuring the vane segment 11 is damaged, only this one vane 20 can be repaired or easily replaced with another vane 20.

In this embodiment, the upstream-side flange portion 38 and the downstream-side flange portion 39 are formed at only each of the outer shrouds 32*a* and 32*a* of the end vanes 20*a* and 20*b*. However, the upstream-side flange portion 38 and the downstream-side flange portion 39 may be formed at each of the outer shrouds 32 of three or more vanes 20 including the end vanes 20*a* and 20*b* of the plurality of vanes 20. In this case, a manufacturing cost increases compared to the vane segment 11 of this embodiment.

Further, the upstream-side flange portion 38 and the downstream-side flange portion 39 may also be formed at only the outer shroud 32 of one vane 20*c* other than the end vanes 20*a* and 20*b*. However, in this case, a place where the connection band 50 is supported so as to be relatively immovable to the outer side in the radial direction with respect to the outer shrouds 32 of the plurality of vanes 20 is only one place in about the middle of the circumferential direction Dc of the connection band 50, and thus supporting of the connection band 50 becomes unstable compared to this embodiment.

Further, only one flange portion of the upstream-side flange portion 38 and the downstream-side flange portion 39 may be formed. Also in this case, supporting of the connection band 50 becomes unstable compared to this embodiment.

Therefore, as the radial restriction section, which restricts the connection band 50 so as to be relatively immovable to the outer side in the radial direction with respect to the outer shrouds 32 of the plurality of vanes 20, the example shown in this embodiment is preferable.

Further, in this embodiment, the respective positioning jigs 61 and 62 are welded to the connection band 50, whereby the respective positioning jigs 61 and 62 are made to be relatively immovable in the radial direction Dr with respect to the connection band 50. However, the respective positioning jigs 61 and 62 may be made to be relatively immovable in the radial direction Dr with respect to the connection band 50 by using other methods. For example, a configuration may also be made so as to provide a pin cap, a pin-pressing plate, or the like which comes into contact with the radial outer end face of each of the positioning jigs 61 and 62 and connect the pin cap, the pin-pressing plate, or the like to the connection band 50 by a connection tool.

In this embodiment, only the positioning jig 62 of the two positioning jigs 61 and 62 is an eccentric pin. However, both the positioning jigs 61 and 62 may be eccentric pins. In addition, in this embodiment, a pin is used as the first positioning jig 61. However, instead of a pin, for example, a bolt may be used. In the present invention, a positioning jig on one side is not limited to a pin.

An example of the vane segment 11 of the compressor 1 has been described above. However, the present invention is not limited thereto and may also be applied to a vane segment of other axial-flow fluid machines such as a turbine.

The present invention relates to a vane segment in which it is possible to suppress deformation or cracking of a vane while reducing rattling between the plurality of vanes and reduce the number of assembly steps.

While preferred embodiments of the present invention have been described and illustrated above, it should be understood that these are exemplary of the present invention and are not to be considered as limiting. Additions, omissions, substitutions, and other modifications can be made without departing from the spirit or scope of the present invention. Accordingly, the present invention is not to be considered as being limited by the foregoing description, and is only limited by the scope of the appended claims.

What is claimed is:

1. A vane segment which configures part of a vane ring and in which a plurality of vanes are connected in a circumferential direction, comprising:

the vane including a vane main body extending in a radial direction of the vane ring, an outer shroud provided at a radial outer side of the vane main body, and grooves formed on the outer shrouds so as to extend in the circumferential direction and dent toward a radial inner side from a radial outer side;

an outer connection member which fit into the grooves and connects the plurality of vanes; and positioning jigs for positioning two end vanes located at both ends in the circumferential direction of the plurality of vanes with respect to the outer connection member; wherein at least one positioning jig of the positioning jigs is an eccentric positioning jig having a first columnar portion and a second columnar portion which is eccentric with respect to a central axis of the first columnar portion, and the end vane on one side in which the eccentric positioning jig is inserted moves toward the end vane on the other side by rotation of the eccentric positioning jig.

2. The vane segment according to claim 1, wherein openings are formed in each of portions of the outer connection member which fit into the grooves of the two end vanes, each of the openings penetrating in the radial direction such that the positioning jig is inserted thereinto, holes are formed in bottoms of the grooves, the holes being dented toward a radial inner side such that the positioning jigs inserted into each of the openings of the outer connection member are inserted thereinto, an inner diameter of at least one of the holes of the two end vanes is an inner diameter which corresponds to an outer diameter of the first columnar portion of the eccentric positioning jig and which allows insertion of the first columnar portion, and an inner diameter of at least one of the two openings of the outer connection member is an inner diameter which corresponds to an outer diameter of the second columnar portion of the eccentric positioning jig and which allows insertion of the second columnar portion.

3. The vane segment according to claim 1, wherein collar portions which face a radial outer surface of the outer connection member fitted into the groove are each formed at the two end vanes, and the collar portions restrict the outer connection member so as to be relatively immovable to an outer side in a radial direction of the vane ring.

4. The vane segment according to claim 1, wherein the two positioning jigs and the outer connection member are welded to each other.

5. The vane segment according to claim 1, wherein each of the plurality of vanes has an inner shroud provided at a radial inner side of the vane main body, and the vane segment further includes an inner connection member which is engaged with the inner shrouds of the plurality of vanes, thereby restricting the inner shrouds so as to be relatively immovable in the radial direction.

6. An axial-flow fluid machine comprising:

ring configured of a plurality of vane segments according to claim 1.

7. The axial-flow fluid machine according to claim 6, wherein openings are formed in each of portions of the outer connection member which fit into the grooves of the two end vanes, each of the openings penetrating in the radial direction such that the positioning jig is inserted thereinto, holes are formed in bottoms of the grooves, the holes being dented toward a radial inner side such that the positioning jigs inserted into each of the openings of the outer connection member are inserted thereinto, an inner diameter of at least one of the holes of the two end vanes is an inner diameter which corresponds to an outer diameter of the first columnar portion of the eccentric positioning jig and which allows insertion of the first columnar portion, and an inner diameter of at least one of the two openings of the outer connection member is an inner diameter which corresponds to an outer diameter of the second columnar portion of the eccentric positioning jig and which allows insertion of the second columnar portion.

8. The axial-flow fluid machine according to claim 6, wherein collar portions which face a radial outer surface of the outer connection member fitted into the groove are respectively formed at the two end vanes, and the collar portions restrict the outer connection member so as to be relatively immovable to an outer side in a radial direction of the vane ring.

9. The axial-flow fluid machine according to claim 6, wherein the two positioning jigs and the outer connection member are welded to each other.

10. The axial-flow fluid machine according to claim 6, wherein each of the plurality of vanes has an inner shroud provided at a radial inner side of the vane main body, and the axial-flow fluid machine further includes an inner connection member which is engaged with the inner shrouds of the plurality of vanes, thereby restricting the inner shrouds so as to be relatively immovable in the radial direction.

* * * * *